US008267125B2

(12) United States Patent
Pitzler et al.

(10) Patent No.: US 8,267,125 B2
(45) Date of Patent: Sep. 18, 2012

(54) PAPERMAKING FORMING FABRIC WITH LONG BOTTOM CMD YARN FLOATS

(75) Inventors: Joachim Pitzler, Trochtelfingen (DE); Jan Freudenberg, Reutlingen (DE); Renate Gleich, Reutlingen (DE)

(73) Assignee: Huyck Licensco Inc., Raleigh, NC (US)

( * ) Notice: Subject to any disclaimer, the term of this patent is extended or adjusted under 35 U.S.C. 154(b) by 0 days.

(21) Appl. No.: 13/312,207

(22) Filed: Dec. 6, 2011

(65) Prior Publication Data

US 2012/0145348 A1 Jun. 14, 2012

Related U.S. Application Data

(60) Provisional application No. 61/422,443, filed on Dec. 13, 2010.

(51) Int. Cl.

| | |
|---|---|
| ***D21F 7/08*** | (2006.01) |
| ***D21F 1/10*** | (2006.01) |
| ***D03D 3/04*** | (2006.01) |
| *D03D 25/00* | (2006.01) |

(52) U.S. Cl. ..... 139/383 A; 139/383 R; 139/409; 162/358.2

(58) Field of Classification Search ..... None
See application file for complete search history.

(56) References Cited

U.S. PATENT DOCUMENTS

| | | | | |
|---|---|---|---|---|
| 4,564,052 | A * | 1/1986 | Borel | 139/425 A |
| 5,238,536 | A * | 8/1993 | Danby | 162/202 |
| 5,277,967 | A * | 1/1994 | Zehle et al. | 442/206 |
| 6,123,116 | A * | 9/2000 | Ward et al. | 139/383 A |
| 6,253,796 | B1 * | 7/2001 | Wilson et al. | 139/383 A |
| 2005/0268981 | A1 * | 12/2005 | Barratte | 139/383 A |
| 2007/0062598 | A1 * | 3/2007 | Barratte | 139/383 A |
| 2007/0251594 | A1 * | 11/2007 | Ward et al. | 139/383 R |
| 2008/0149214 | A1 * | 6/2008 | Quigley | 139/410 |

(Continued)

FOREIGN PATENT DOCUMENTS

| | | |
|---|---|---|
| EP | 0 245 851 A2 | 11/1987 |
| EP | 1 605 095 A1 | 12/2005 |

OTHER PUBLICATIONS

The International Search Report and the Written Opinion for PCT/US2011/063863 mailed Mar. 15, 2012.

*Primary Examiner* — Bobby Muromoto, Jr.
(74) *Attorney, Agent, or Firm* — Myers Bigel Sibley & Sajovec

(57) ABSTRACT

A papermaking forming fabric includes a series of repeat units, wherein each repeat units includes: a set of top machine direction (MD) yarns; a set of top cross-machine direction (CMD) yarns interwoven with the top MD yarns to form a top fabric layer; a set of bottom MD yarns; a set of bottom CMD yarns interwoven with the bottom MD yarns to form a bottom fabric layer; and a set of stitching yarns interwoven with the top and bottom fabric layers. The bottom MD yarns and bottom CMD are woven such that floats formed by the bottom CMD yarns under the bottom MD yarns are at least 1.8 mm in length. A first ratio of top MD yarn coverage area to bottom MD yarn coverage area is less than 0.5, and a second ratio of bottom CMD yarn cross-sectional area to bottom MD yarn cross-sectional area is greater than 2.0.

11 Claims, 6 Drawing Sheets

U.S. PATENT DOCUMENTS

2008/0178958 A1* 7/2008 Barratte et al. ..... 139/383 A
2009/0183795 A1* 7/2009 Ward et al. ..... 139/410
2010/0108175 A1* 5/2010 Barratte ..... 139/383 A
2010/0147410 A1* 6/2010 Ward et al. ..... 139/410
2011/0100577 A1 5/2011 Baumann
2011/0253334 A1* 10/2011 Rossetti ..... 162/202

* cited by examiner

PAPERMAKING FORMING FABRIC WITH LONG BOTTOM CMD YARN FLOATS

RELATED APPLICATION

This application claims priority from and the benefit of U.S. Provisional Patent Application No. 61/422,443, filed Dec. 13, 2010, the disclosure of which is hereby incorporated herein in its entirety.

FIELD OF THE INVENTION

This application is directed generally to papermaking, and more specifically to fabrics employed in papermaking.

BACKGROUND OF THE INVENTION

In the conventional fourdrinier papermaking process, a water slurry, or suspension, of cellulosic fibers (known as the paper "stock") is fed onto the top of the upper run of an endless belt of woven wire and/or synthetic material that travels between two or more rolls. The belt, often referred to as a "forming fabric," provides a papermaking surface on the upper surface of its upper run that operates as a filter to separate the cellulosic fibers of the paper stock from the aqueous medium, thereby forming a wet paper web. The aqueous medium drains through mesh openings of the forming fabric, known as drainage holes, by gravity or vacuum located on the lower surface of the upper run (i.e., the "machine side") of the fabric.

After leaving the forming section, the paper web is transferred to a press section of the paper machine, where it is passed through the nips of one or more pairs of pressure rollers covered with another fabric, typically referred to as a "press felt." Pressure from the rollers removes additional moisture from the web; the moisture removal is enhanced by the presence of a "batt" layer of the press felt. The paper is then transferred to a dryer section for further moisture removal. After drying, the paper is ready for secondary processing and packaging.

As used herein, the terms machine direction ("MD") and cross machine direction ("CMD") refer, respectively, to a direction aligned with the direction of travel of the papermakers' fabric on the papermaking machine, and a direction parallel to the fabric surface and traverse to the direction of travel. Likewise, directional references to the vertical relationship of the yarns in the fabric (e.g., above, below, top, bottom, beneath, etc.) assume that the papermaking surface of the fabric is the top of the fabric and the machine side surface of the fabric is the bottom of the fabric.

Typically, papermaker's fabrics are manufactured as endless belts by one of two basic weaving techniques. In the first of these techniques, fabrics are flat woven by a flat weaving process, with their ends being joined to form an endless belt by any one of a number of well-known joining methods, such as dismantling and reweaving the ends together (commonly known as splicing), or sewing on a pin-seamable flap or a special foldback on each end, then reweaving these into pin-seamable loops. A number of auto-joining machines are now commercially available, which for certain fabrics may be used to automate at least part of the joining process. In a flat woven papermaker's fabric, the warp yarns extend in the machine direction and the filling yarns extend in the cross machine direction.

In the second basic weaving technique, fabrics are woven directly in the form of a continuous belt with an endless weaving process. In the endless weaving process, the warp yarns extend in the cross machine direction and the filling yarns extend in the machine direction. Both weaving methods described hereinabove are well known in the art, and the term "endless belt" as used herein refers to belts made by either method.

Effective sheet and fiber support are important considerations in papermaking, especially for the forming section of the papermaking machine, where the wet web is initially formed. Additionally, the forming fabrics should exhibit good stability when they are run at high speeds on the papermaking machines, and preferably are highly permeable to reduce the amount of water retained in the web when it is transferred to the press section of the paper machine. In both tissue and fine paper applications (i.e., paper for use in quality printing, carbonizing, cigarettes, electrical condensers, and like) the papermaking surface comprises a very finely woven or fine wire mesh structure.

Typically, finely woven fabrics such as those used in fine paper and tissue applications include at least some relatively small diameter machine direction or cross machine direction yarns. Regrettably, however, such yarns tend to be delicate, leading to a short surface life for the fabric. Moreover, the use of smaller yarns can also adversely affect the mechanical stability of the fabric (especially in terms of skew resistance, narrowing propensity and stiffness), which may negatively impact both the service life and the performance of the fabric.

To combat these problems associated with fine weave fabrics, multi-layer forming fabrics have been developed with fine-mesh yarns on the paper forming surface to facilitate paper formation and coarser-mesh yarns on the machine contact side to provide strength and durability. For example, fabrics have been constructed which employ one set of machine direction yarns which interweave with two sets of cross machine direction yarns to form a fabric having a fine paper forming surface and a more durable machine side surface. These fabrics form part of a class of fabrics which are generally referred to as "double layer" fabrics. Similarly, fabrics have been constructed which include two sets of machine direction yarns and two sets of cross machine direction yarns that form a fine mesh paper side fabric layer and a separate, coarser machine side fabric layer. In these fabrics, which are part of a class of fabrics generally referred to as "triple layer" fabrics, the two fabric layers are typically bound together by separate stitching yarns. However, they may also be bound together using yarns from one or more of the sets of bottom and top cross machine direction and machine direction yarns. As double and triple layer fabrics include additional sets of yarn as compared to single layer fabrics, these fabrics typically have a higher "caliper" (i.e., they are thicker) than comparable single layer fabrics. An illustrative double layer fabric is shown in U.S. Pat. No. 4,423,755 to Thompson, and illustrative triple layer fabrics are shown in U.S. Pat. No. 4,501,303 to Osterberg, U.S. Pat. No. 5,152,326 to Vohringer, U.S. Pat. Nos. 5,437,315 and 5,967,195 to Ward, and U.S. Pat. No. 6,745,797 to Troughton.

Efficient drainage of water from a forming fabric can be an issue in papermaking. One solution for efficient drainage is proposed in co-assigned U.S. Patent Publication No, 2011/0100577 to Baumann, the disclosure of which is hereby incorporated herein by reference. Baumann describes the use of engineered channels formed by the interstices in the fabric to provide efficient drainage. It would be desirable to provide additional fabrics that expand on this concept.

SUMMARY OF THE INVENTION

As a first aspect, embodiments of the invention are directed to a papermaking forming fabric that comprises a series of repeat units. Each of the repeat units comprises: a set of top machine direction (MD) yarns; a set of top cross-machine direction (CMD) yarns interwoven with the top MD yarns to form a top fabric layer; a set of bottom MD yarns; a set of bottom CMD yarns interwoven with the bottom MD yarns to form a bottom fabric layer; and a set of stitching yarns interwoven with the top and bottom fabric layers. The bottom MD yarns and bottom CMD are woven such that floats formed by the bottom CMD yarns under the bottom MD yarns are at least 1.8 mm in length. A first ratio of top MD yarn coverage area to bottom MD yarn coverage area is less than 0.5, and a second ratio of bottom CMD yarn cross-sectional area to bottom MD yarn cross-sectional area is greater than 2.0. In this structure, the fabric can provide improved drainage capacity. The drainage can be controlled due to the special structure on the running side of the fabric in combination with an increased open surface area on the paper side. Also, the running side structure can provide increased bending stiffness and machine side wear.

As a second aspect, embodiments of the invention are directed to a papermaking forming fabric that comprises a series of repeat units, each of the repeat units comprising: a set of top MD yarns; a set of top CMD yarns interwoven with the top MD yarns to form a top fabric layer; a set of bottom MD yarns; a set of bottom CMD yarns interwoven with the bottom MD yarns to form a bottom fabric layer; and a set of stitching yarns interwoven with the top and bottom fabric layers. The bottom MD yarns and bottom CMD are woven such that floats formed by the bottom CMD yarns under the bottom MD yarns are between about 1.8 mm and 3.0 mm in length. A first ratio of top MD yarn coverage area to bottom MD yarn coverage area is between about 0.3 and 0.5, and a second ratio of bottom CMD yarn cross-sectional area to bottom MD yarn cross-sectional area is between about 2.0 and 15.0.

DETAILED DESCRIPTION OF EMBODIMENTS OF THE INVENTION

Figure 1:
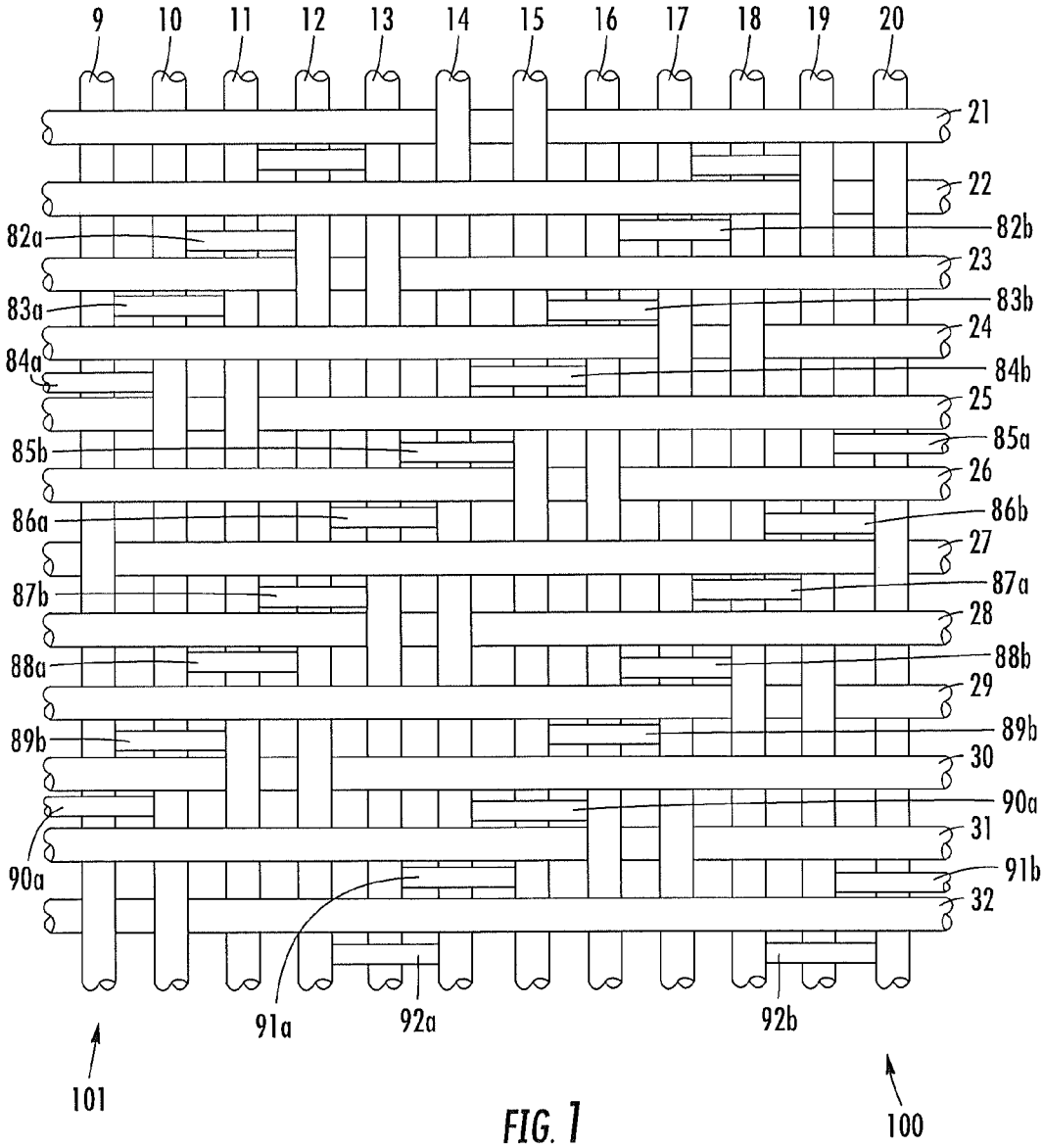
FIG. 1 is a bottom view of a papermaking fabric according to embodiments of the present invention, wherein the running side (or machine side) of the fabric is shown.

The present invention will now be described more fully hereinafter, in which embodiments of the invention are shown. This invention may, however, be embodied in different forms and should not be construed as limited to the embodiments set forth herein. Rather, these embodiments are provided so that this disclosure will be thorough and complete, and will fully convey the scope of the invention to those skilled in the art. In the drawings, like numbers refer to like elements throughout. Thicknesses and dimensions of some components may be exaggerated for clarity.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein the expression "and/or" includes any and all combinations of one or more of the associated listed items.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. The device may be otherwise oriented (rotated 90 degrees or at other orientations) and the spatially relative descriptors used herein interpreted accordingly.

Well-known functions or constructions may not be described in detail for brevity and/or clarity.

As used herein, the terms "machine direction" (MD) and "cross machine direction" (CMD) refer, respectively, to a direction aligned with the direction of travel of the papermakers' fabric on a papermaking machine, and a direction parallel to the fabric surface and transverse to the direction of travel. Also, both the flat weaving and endless weaving methods described hereinabove are well known in this art, and the term "endless belt" as used herein refers to belts made by either method.

Figure 2:
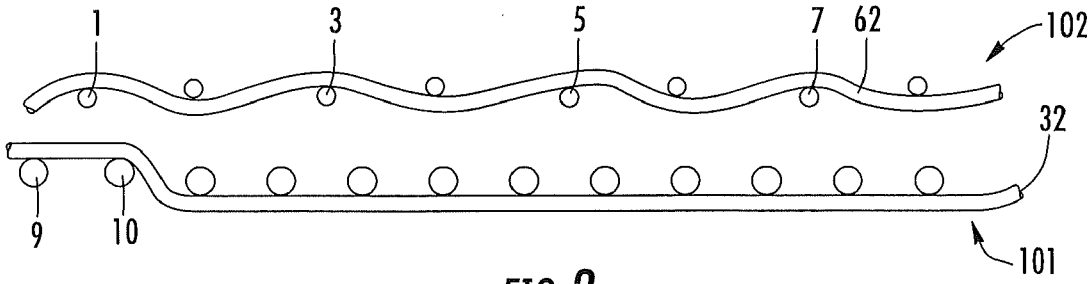
FIG. 2 is a cross-section of the fabric of FIG. 1 showing typical top and bottom CMD yarns.
Figure 3:
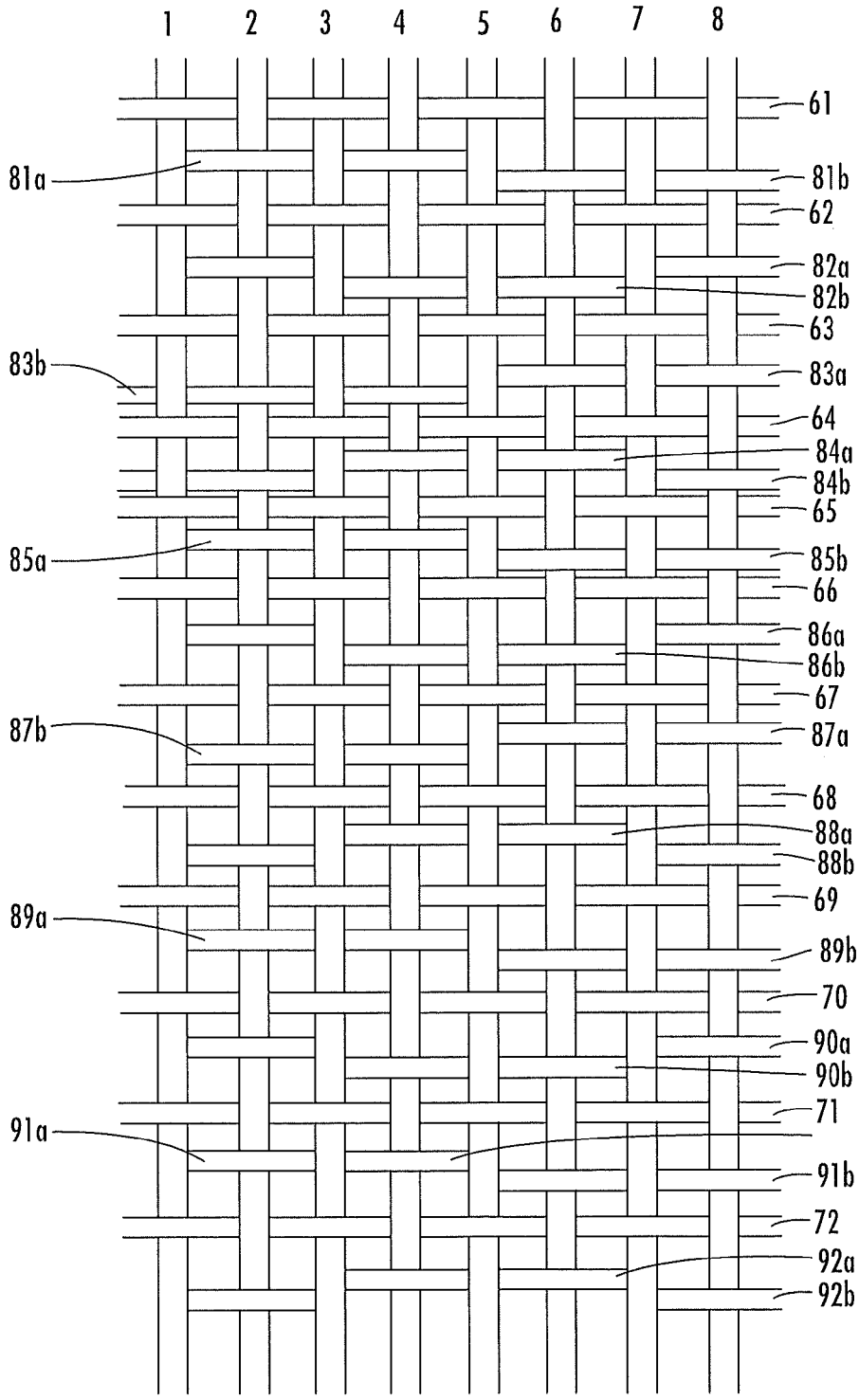
FIG. 3 is a schematic diagram depicting the top layer of the fabric of FIG. 1 showing the paper side thereof. In the diagram, darkened boxes indicate locations in which a top CMD yarn or stitching yarn passes over a top MD yarn.

Referring now to the figures, a papermaking fabric, designated broadly at 100, is shown in FIGS. 1-4. FIG. 1 shows the running side ("RS") of the fabric 100 (i.e., the side facing the papermaking machine, referred to herein also as the "bottom" side of the fabric 100), and FIG. 3 shows the paper side ("PS") or "top" side of the fabric 100.

Figure 4:
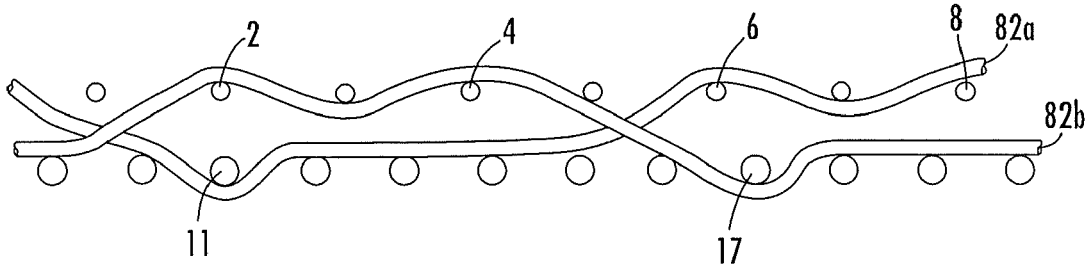
FIG. 4 is a cross-section of the fabric of FIG. 1 showing typical stitching yarns.

Referring to FIG. 1, the running side of the fabric 100 includes twelve bottom MD yarns 9-20 and twelve bottom CMD yarns 21-32 that form a bottom layer 101. The bottom CMD yarns 21-32 are interwoven with the bottom MD yarns 9-20 in an "over 2/under 10" sequence (for reference purposes, herein the terms "over" and "under" are used with respect to the paper side of the fabric 10 being "up" and the running side being "down", as is shown in FIGS. 2 and 4, with the understanding that in the bottom view of FIG. 1, yarns seen as passing "over" other yarns actually pass "under" those yarns with the paper side chosen as being "up"). With an "over 2/under 10" sequence, a 10-yarn "float" is formed by each bottom CMD yarn 21-32 under ten bottom MD yarns.

For example, bottom CMD yarn 32 passes over bottom MD yarns 9 and 10 and under bottom MD yarns 11-20, thereby forming the aforementioned 10-yarn float under bottom MD yarns 11-20 (see FIG. 2).

Each bottom CMD yarn is offset from its immediate bottom CMD yarn neighbors by five bottom MD yarns. For example, bottom CMD yarn 32 passes over bottom MD yarns 9 and 10, whereas its immediate bottom CMD neighbor yarn 21 passes over bottom MD yarns 14 and 15, which are offset from bottom MD yarns 9 and 10 by five bottom MD yarns each. The remaining bottom MD yarns follow a similar offset pattern (see FIG. 1).

FIG. 3 illustrates the top layer 102 of the fabric 100, which includes eight top MD yarns 1-8, twelve top CMD yarns 51-62, and twelve stitching yarn pairs 71*a*, 71*b*-82*a*, 82*b*, with a stitching yarn pair being located between adjacent top CMD yarns. The top MD yarns 1-8, top CMD yarns 51-62 and stitching yarn pairs 71*a*, 71*b*-82*a*, 82*b* are interwoven to form a plain weave surface on the top layer 102.

As can be seen in FIGS. 2 and 3, a typical top CMD yarn, such as top CMD yarn 62, follows an "over 1/under 1" sequence as it weaves with the top MD yarns 1-8. As exemplified in FIG. 4 by stitching yarn pair 82*a*, 82*b*, each stitching yarn interweaves with three top MD yarns (passing over two top MD yarns and under the top MD yarn therebetween) and passes under one bottom MD yarn. For example, stitching yarn 82*a* passes over top MD yarns 2 and 4 and under top MD yarn 3, and passes under bottom MD yarn 17, while stitching yarn 82*b* passes over top MD yarns 6 and 8 and under bottom MD yarn 11. Thus, together the stitching yarns 82*a*, 82*b* (and each other pair) form the equivalent of one top CMD yarn that weaves in the "over 1/under 1" sequence followed by the top CMD yarns. As a result, together the top MD yarns 1-8, the top CMD yarns 61-72, and the portions of the stitching yarns 81*a*, 81*b*-92*a*, 92*b* that weave with the top MD yarns form a plain weave surface for the top layer 102. Such top surface constructions are well-known (exemplified in, for example, U.S. Pat. No. 5,967,195 to Ward, the disclosure of which is hereby incorporated herein) and need not be described in detail herein. Exemplary versions of the running side 101 of the fabric 100 are described in Table 1 below.

TABLE 1

| Property | Version 1 | Version 2 |
|---|---|---|
| Bottom CMD yarn Diameter (mm) | 0.27 | 0.27 |
| Bottom MD yarn Diameter (mm) | 0.19 | 0.14 |
| Bottom MD yarns/cm | 36 | 52.5 |
| RS CMD Float length (mm) | 2.95 | 1.90 |
| Top MD yarn diameter (mm) | 0.14 | 0.10 |
| Top MD yarns/cm | 24 | 35 |
| Bottom CMD yarns/cm | 20 | 22.5 |
| PS MD yarn coverage area/RS MD yarn coverage area | 0.49 | 0.47 |
| RS CMD yarn cross-sectional area/RS MD yarn cross-sectional area | 2.02 | 3.80 |

In particular, fabrics that exhibit a combination of (a) a ratio of RS CMD yarn cross-sectional area/RS MD yarn cross-sectional area of >2.0; (b) RS CMD floats of greater than 1.8 mm, and (c) a ratio of PS MD yarn coverage area to RS MD yarn coverage area of <0.5, can be advantageous. This arrangement can provide engineered drainage channels such as those as described in the aforementioned U.S. Patent Publication No. 2011/0100577 to Baumann. Also, this arrangement can provide a relatively long RS float, which can increase wear volume of the fabric. Wear volume may also be increased by the double RS knuckle formed by the bottom MD yarn, as this can generate sufficient crimp at high bottom CMD yarn diameters. There also may be less rewetting on high vacuum elements due to the relative close bottom side structure.

Regarding conditions (a) to (c) above, ratios of RS MCD yarn cross-sectional area/RS MD yarn cross-sectional area (i.e., condition (a) above) may be between about 2.0 and 15.0 in some embodiments, and between about 2.0 and 10.0 in other embodiments. RS CMD float lengths (i.e., condition (b) above) may be between about 1.8 mm and 3.5 mm in some embodiments, and between about 1.8 and 3.0 mm in other embodiments. The ratio of PS MD yarn coverage area to RS MD yarn coverage area (condition (c) above) may be between about 0.3 and 0.5 in some embodiments, and between about 0.4 and 0.5 in other embodiments.

Figure 5:
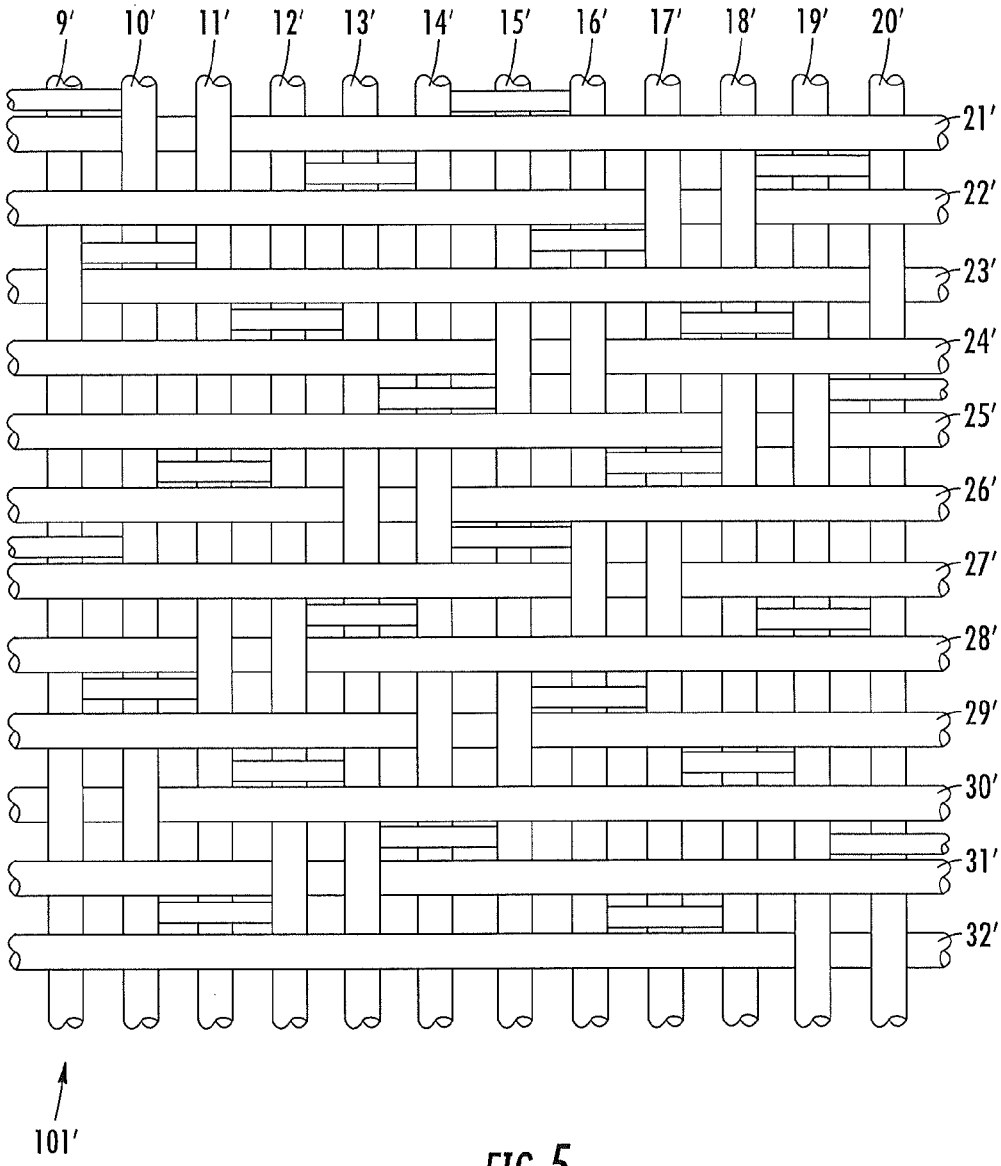
FIG. 5 is a bottom view of the machine side of a papermaking fabric according to alternative embodiments of the present invention.

FIG. 5 illustrates an alternative running side pattern for the fabric 100. In this embodiment (designated at 101'), the bottom CMD yarns 21'-32' are interwoven with the bottom MD yarns 9'-20' to form 10-yarn CMD floats (as is the case with the fabric 100), but each bottom CMD yarn is offset by seven bottom MD yarns from one adjacent CMD yarn and by three bottom MD yarns from the other adjacent CMD yarn. For example, bottom CMD yarn 22' passes over bottom MD yarns 17', 18'. Adjacent bottom CMD yarn 21' passes over bottom MD yarns 10', 11', and is therefore offset from bottom CMD yarn 22' by seven bottom MD yarns. Adjacent bottom CMD yarn 23' passes over bottom MD yarns 20', 9', and is therefore offset from bottom CMD yarn 22' by three bottom MD yarns. This pattern is repeated throughout the running side 101'.

Figure 6:
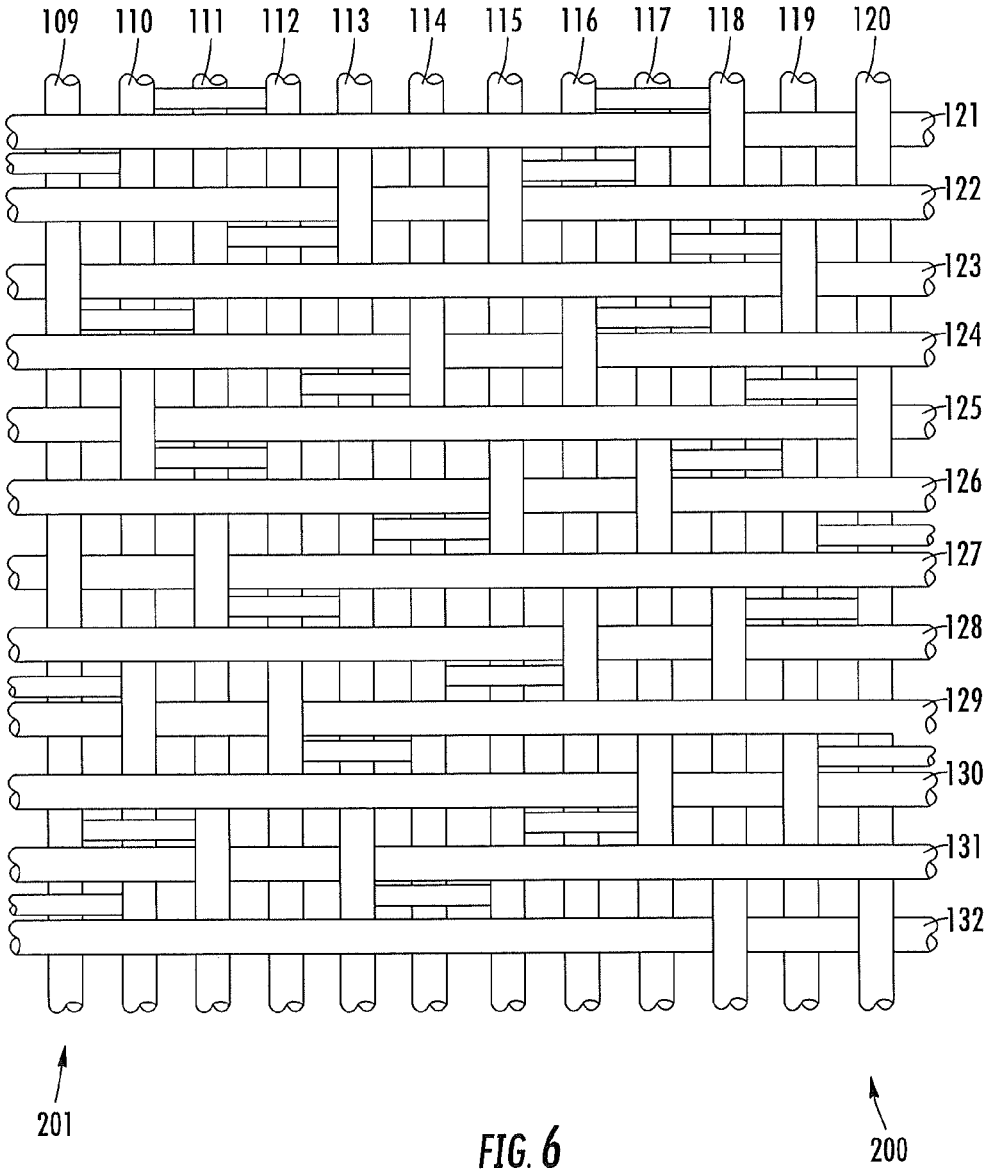
FIG. 6 is a bottom view of a papermaking fabric according to further embodiments of the invention, wherein the running side of the fabric is shown.

FIG. 6 shows an alternative embodiment of the running side 201 of a fabric 200, in which is similar to the fabric 100 with the exception that the bottom CMD yarns 121-132 follow an "over 1/under 1/over 1/under 9" sequence with respect to the bottom MD yarns 109-120. The remaining yarns (i.e., the top MD yarns, the top CMD yarns, and the stitching yarns) may follow the same weave pattern as the fabric 100. The wear volume advantages exhibited by the fabric 100 may also be enjoyed by the fabric 200, as an arrangement of two bottom side MD knuckles separated by just one bottom MD yarn can provide both a relatively long bottom side CMD float (2.76 mm) and sufficient crimp for high bottom CMD yarn diameters.

Figure 7:
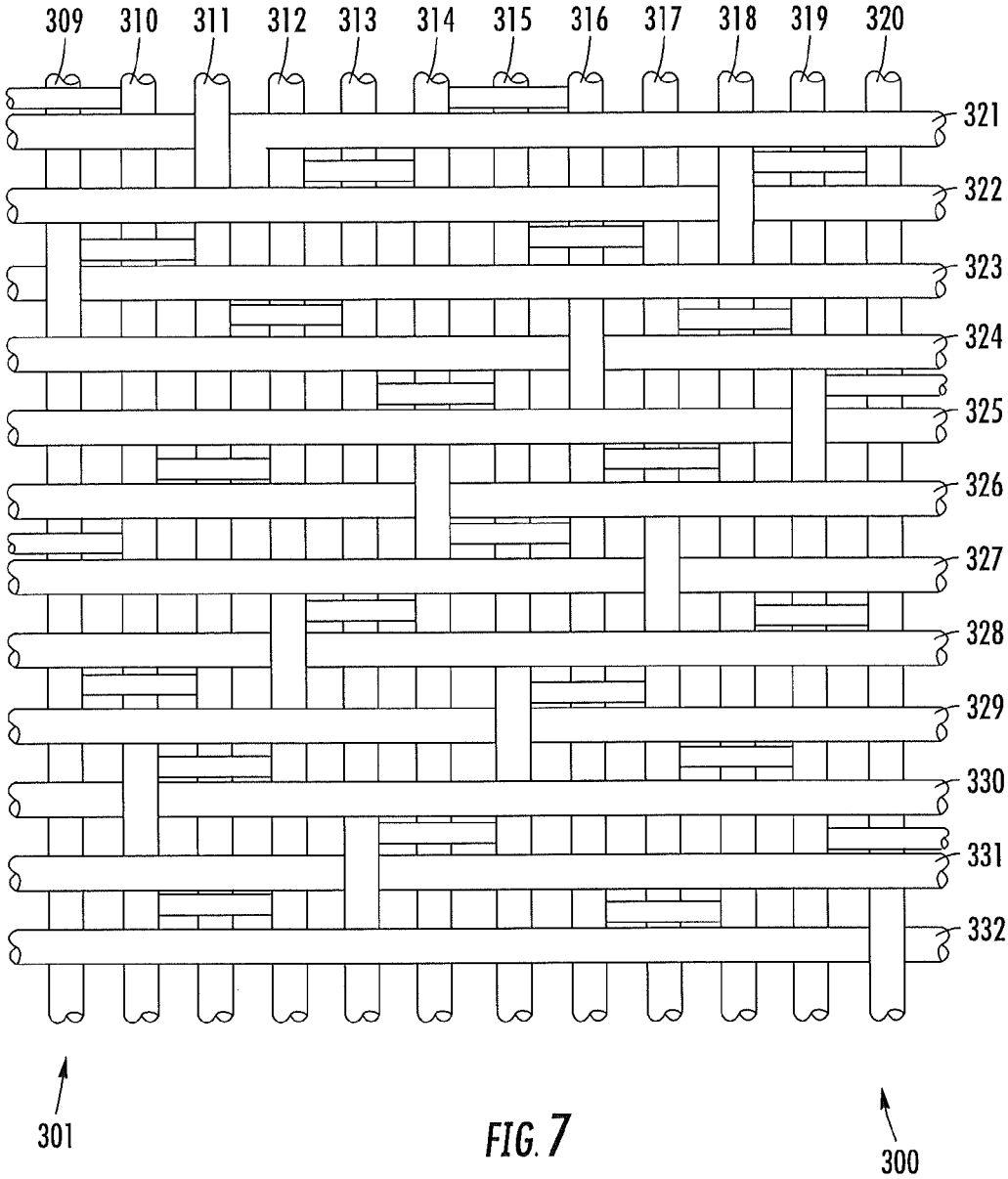
FIG. 7 is a bottom view of a papermaking fabric according to still further embodiments of the invention, wherein the running side of the fabric is shown.

FIG. 7 illustrates the running side 301 of another fabric, designated broadly at 300, according to embodiments of the invention. The running side 301 includes twelve bottom MD yarns 309-320 and twelve bottom CMD yarns 321-332. The bottom CMD 321-332 yarns are interwoven with the bottom MD yarns 309-320 in an "over 1/under 1" pattern, such that the bottom CMD yarns 321-332 form 11-yarn running side floats. As can be seen in FIG. 7 (and as was the case for the fabric of FIG. 5), each bottom CMD yarn is offset by seven bottom MD yarns from one adjacent CMD yarn and by three bottom MD yarns from the other adjacent CMD yarn. For example, bottom CMD yarn 322 passes over bottom MD yarn 318. Adjacent bottom CMD yarn 321 passes over bottom MD yarn 311, and is therefore offset from bottom CMD yarn 322 by seven bottom MD yarns. Adjacent bottom CMD yarn 323 passes over bottom MD yarn 309, and is therefore offset from bottom CMD yarn 322 by three bottom MD yarns. This pattern is repeated through the running side 301.

Table 2 shows that different combinations of yarn diameters can fulfill the conditions (a)-(c) discussed above. The properties set forth in Table 2 are applicable to any of the fabrics 100, 200, 300.

TABLE 2

| Bottom CMD Yarn Diameter (mm) | 0.22 | 0.25 | 0.27 | 0.3 | 0.35 | 0.4 | 0.45 | 0.5 |
|---|---|---|---|---|---|---|---|---|
| Cross-sectional yarn area ($mm^2$) | 0.038 | 0.049 | 0.057 | 0.071 | 0.096 | 0.126 | 0.159 | 0.196 |
| RS CMD yarn area/RS MD yarn area | | | | | | | | |
| Bottom MD Yarn Diameter - 0.19 mm (cross-sectional area - 0.028 $mm^2$) | | | 2.02 | 2.49 | 3.39 | 4.43 | 5.81 | 6.93 |
| Bottom MD Yarn Diameter - 0.14 mm (cross-sectional area - 0.015 $mm^2$) | 2.53 | 3.26 | 3.8 | 4.59 | 6.25 | 8.16 | 10.33 | 12.76 |
| Bottom MD Yarn Diameter - 0.24 mm (cross-sectional area - 0.045 $mm^2$) | | | | | 2.13 | 2.76 | 3.52 | 4.34 |

Test results indicate, in comparison with a standard triple layer forming fabric, an impact in drainage behavior of about 25% increased drainage and about 1-2% higher dryness (absolute); a higher surface open area of up to 3-4% (absolute); about 10% higher bending stiffness and about 20% higher wear potential.

Those skilled in this art will appreciate that other weave patterns may also be employed. For example, in the fabrics 100, 200, 300 the ratio of effective top CMD yarns (i.e., the number of top CMD yarns and stitching yarn pairs) to bottom CMD yarns is 2:1. This ratio may be varied, as fabrics that have ratios of 1:1, 3:2, 5:2 or even 3:1 may also be employed. Further, although a ratio of top CMD yarns to stitching yarn pairs of 1:1 is shown, this ratio may vary also; for example, 2:1 or 3:1 may also be used.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as recited in the claims.

That which is claimed is:

1. A papermaking forming fabric that comprises a series of repeat units, each of the repeat units comprising:

a set of top machine direction (MD) yarns;

a set of top cross-machine direction (CMD) yarns interwoven with the top MD yarns to form a top fabric layer;

a set of bottom MD yarns;

a set of bottom CMD yarns interwoven with the bottom MD yarns to form a bottom fabric layer;

a set of stitching yarns interwoven with the top and bottom fabric layers;

wherein the bottom MD yarns and bottom CMD are woven such that floats formed by the bottom CMD yarns under the bottom MD yarns are at least 1.8 mm in length; and wherein a first ratio of top MD yarn coverage area to bottom MD yarn coverage area is less than 0.5; and wherein a second ratio of bottom CMD yarn cross-sectional area to bottom MD yarn cross-sectional area is greater than 2.0.

2. The papermaking forming fabric defined in claim 1, wherein the top MD yarns, the top CMD yarns, and the stitching yarns combine to form a plain weave on the top surface of the fabric.

3. The papermaking forming fabric defined in claim 1, wherein the stitching yarns are CMD stitching yarns.

4. The papermaking forming fabric defined in claim 1, wherein the floats formed by the bottom CMD yarns between about 1.8 and 3.5 mm.

5. The papermaking forming fabric defined in claim 1, wherein the first ratio is between about 0.3 and 0.5.

6. The papermaking forming fabric defined in claim 1, wherein the second ratio is between about 2.0 and 15.0.

7. The papermaking forming fabric defined in claim 1, wherein the diameter of the bottom MD yarns is between about 0.13 and 0.3 mm.

8. A papermaking forming fabric that comprises a series of repeat units, each of the repeat units comprising:

a set of top machine direction (MD) yarns;

a set of top cross-machine direction (CMD) yarns interwoven with the top MD yarns to form a top fabric layer;

a set of bottom MD yarns;

a set of bottom CMD yarns interwoven with the bottom MD yarns to form a bottom fabric layer;

a set of stitching yarns interwoven with the top and bottom fabric layers;

wherein the bottom MD yarns and bottom CMD are woven such that floats formed by the bottom CMD yarns under the bottom MD yarns are between about 1.8 mm and 3.0 mm in length; and wherein a first ratio of top MD yarn coverage area to bottom MD yarn coverage area is between about 0.3 and 0.5; and wherein a second ratio of bottom CMD yarn cross-sectional area to bottom MD yarn cross-sectional area is between about 2.0 and 15.0.

9. The papermaking forming fabric defined in claim 8, wherein the top MD yarns, the top CMD yarns, and the stitching yarns combine to form a plain weave on the top surface of the fabric.

10. The papermaking forming fabric defined in claim 8, wherein the stitching yarns are CMD stitching yarns.

11. The papermaking forming fabric defined in claim 8, wherein the diameter of the bottom MD yarns is between about 0.13 and 0.3 mm.

* * * * *

UNITED STATES PATENT AND TRADEMARK OFFICE

CERTIFICATE OF CORRECTION

PATENT NO. : 8,267,125 B2
APPLICATION NO. : 13/312207
DATED : September 18, 2012
INVENTOR(S) : Pitzler et al.

It is certified that error appears in the above-identified patent and that said Letters Patent is hereby corrected as shown below:

On Title Page:

Item (57), Abstract, Line 2, Please replace "each repeat units includes:"
to read -- each repeat unit includes: --
Line 9, Please replace "bottom CMD are woven such that"
to read -- bottom CMD yarns are woven such that --

In the Claims:

Column 7, Claim 1, Line 50: Please correct "and bottom CMD are woven"
to read -- and bottom CMD yarns are woven --

Column 8, Claim 8, Line 38: Please correct "and bottom CMD are woven"
to read -- and bottom CMD yarns are woven --

Signed and Sealed this
Nineteenth Day of March, 2013

Teresa Stanek Rea
*Acting Director of the United States Patent and Trademark Office*